US010064490B1

(12) United States Patent
Davis

(10) Patent No.: US 10,064,490 B1
(45) Date of Patent: Sep. 4, 2018

(54) TEMPLATE FOR POSITIONING MULTIPLE SEATS IN A ROW

(71) Applicant: Edward H. Davis, Melrose, WI (US)

(72) Inventor: Edward H. Davis, Melrose, WI (US)

( * ) Notice: Subject to any disclaimer, the term of this patent is extended or adjusted under 35 U.S.C. 154(b) by 144 days.

(21) Appl. No.: 15/294,192

(22) Filed: Oct. 14, 2016

Related U.S. Application Data

(60) Provisional application No. 62/246,268, filed on Oct. 26, 2015.

(51) Int. Cl.
*B43L 7/02* (2006.01)
*A47C 1/12* (2006.01)

(52) U.S. Cl.
CPC ..... *A47C 1/12* (2013.01)

(58) Field of Classification Search
CPC ..... B43L 13/20; B43L 7/02; B43L 7/10
USPC ..... 33/1 G, 465, 479, 563
See application file for complete search history.

(56) References Cited

U.S. PATENT DOCUMENTS 852,077 A * 4/1907 Nilsson ..... B43L 7/02 33/341
1,549,271 A * 8/1925 Larson ..... B43L 7/02 33/469
1,673,577 A * 6/1928 McGee ..... G01B 3/06 33/418
2,582,649 A * 1/1952 Olson ..... B43L 7/02 33/469
3,096,586 A * 7/1963 Albright ..... B25H 7/00 33/26
D215,757 S * 10/1969 Chang ..... B43L 7/02 33/479
3,526,039 A * 9/1970 Dolgorukov ..... B43L 7/02 33/479
5,353,509 A * 10/1994 Black ..... G01C 9/28 33/376
6,141,882 A * 11/2000 Syken ..... B43L 7/12 33/455
6,851,201 B1 * 2/2005 Gioia ..... B43L 7/02 33/42
2014/0115908 A1 * 5/2014 Kim ..... B43L 7/10 33/666
2015/0292855 A1 * 10/2015 Rao ..... E04F 21/0076 33/526

* cited by examiner

*Primary Examiner* — G. Bradley Bennett
(74) *Attorney, Agent, or Firm* — Tipton L. Randall

(57) ABSTRACT

A planar, T-shaped template member has a linear leg section with a first end thereof intersecting a cross bar section at a center thereof. The cross bar section has opposed ends, each end having a feature at a selected location therein. The cross bar section also has a circular aperture there through positioned opposite the leg section, with the circular aperture connected to an access channel extending to an edge of the cross bar section opposite the linear leg section. The linear leg section has a protrusion at a second end thereof opposite the cross bar section. The protrusion is sized to pivotally fit into the circular aperture and access channel of an identical T-shaped planar template member, thereby allowing pivotal movement between connected planar T-shaped template members. A large number of such templates can be connected together in a line.

14 Claims, 5 Drawing Sheets

TEMPLATE FOR POSITIONING MULTIPLE SEATS IN A ROW

CROSS-REFERENCE TO RELATED APPLICATIONS, IF ANY

This application claims the benefit under 35 U.S.C. § 119 (e) of provisional application Ser. No. 62/246,268, filed 26 Oct. 2015. Application Ser. No. 62/246,268 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to templates and, more particularly, to templates for locating attachment points for a seat or chair and, most particularly, to a template for locating attachment points for multiple seats or chairs in a row.

2. Background Information

Although it is relatively simple to arrange a large number of movable seats or chairs in rows in a large space, the positioning and fastening of permanent seating to a floor in a large space can be very difficult and time consuming. Permanent seating is commonly provided in large public or private buildings. Such seating is securely fastened to the floor with threaded fasteners, such as bolts or screws, to prevent movement. Often the seating units are connected together to maximize the number of seating units in a given space. Careful placement of the anchoring fasteners into the floor is required to produce proper alignment of rows of adjacent seating units. Often, it is necessary to provide curvature of the rows of seating units for aesthetic or utilitarian purposes. This adds to the necessity for precise placement of the anchoring fasteners. Errors in location of one of the holes for the permanent fasteners can cause misalignment for the whole row of seats. Such errors are costly to repair at best.

Applicant has invented a template that provides location of the fastening points for multiple seating units in a row. A plurality of such templates can be linked together so that all fastening points for a row of seating units can be determined and prepared at one time. In addition, the plurality of linked templates can be adjusted to provide a straight line of seating or a curved line of seating.

SUMMARY OF THE INVENTION

The invention is directed to a planar, T-shaped template member having a linear leg section with a first end thereof intersecting a cross bar section at a center of the cross bar. The cross bar section has opposed ends, each cross bar end having a feature at a selected locations therein. The cross bar section also has a circular aperture there through positioned opposite and aligned with the leg section, with the circular aperture connected to an access channel extending to an edge of the cross bar section opposite the linear leg section. The linear leg section has a circular protrusion at a second end thereof opposite the cross bar section. The protrusion is sized to pivotally fit into the circular aperture and access channel of an identical T-shaped planar template member, thereby allowing pivotal movement between connected planar T-shaped template members. A large number of such templates can be connected together in a line.

In a preferred embodiment, the planar, T-shaped template member has a linear leg section with a first end intersecting a cross bar section at a center of the cross bar. The cross bar section has opposed ends, each cross bar end having an arc channel feature therein. The cross bar section has a circular aperture there through positioned opposite and aligned with the leg section, with the circular aperture connected to an access channel extending to an edge of the cross bar section opposite the linear leg section. The linear leg section had a circular protrusion at a second end thereof opposite the cross bar section. The circular protrusion is sized to pivotally fit into the circular aperture and access channel of an identical T-shaped planar template member, thereby allowing limited pivotal movement between connected T-shaped planar template members. A large number of such templates can be connected together in a line.

In a further embodiment of the invention, the surface of the cross bar section surrounding the circular aperture contains a plurality of spaced apart surface lines each extending radially outward from the circular aperture. In addition, the surface of the protrusion of the second end of the linear leg section, sized to pivotally fit into the circular aperture, contains a like plurality of spaced apart surface lines each extending radially inward from the edge thereof. The spacing between the radially extending lines of each surface are not identical. Thus, alignment of a selected pair of surface lines, one from each surface, results in a corresponding angle between adjacent, connected planar template members. Thus, identical angles between adjacent, connected planar template members can be maintained for a long string of such template members.

DESCRIPTION OF THE EMBODIMENTS

Nomenclature

10 Planar, T-shaped Template Member
20 Linear Leg Section
22 First End of Linear Leg Section
24 Second End of Linear Leg Section
30 Cross Bar Section
32 First End of Cross Bar Section
34 Second End of Cross Bar Section
36 Arc Features of Cross Bar Section
40 Circular Aperture of Cross Bar Section
45 Access Channel of Cross Bar Section
50 Protrusion of Second End of Linear Leg Section
60 Radially Extending Surface Lines of Protrusion and Circular Aperture
70 Cross Bar End Piece
72 First End of Cross Bar End Piece
74 Second End of Cross Bar End Piece
76 Arc Features of Cross Bar End Piece
80 Spacer Connecting Pieces Construction The invention is a template that provides location of the fastening points on a support surface for multiple seating units in a row. A plurality of such templates can be linked together so that multiple fastening points for a row of seating units can be determined at one time. In addition, the plurality of linked templates can be adjusted to provide a straight line of seating or a curved line of seating. Careful placement of the anchoring fasteners into the support surface is required to produce proper alignment of rows of adjacent seating units. Often, it is necessary to provide curvature of the rows of seating units for aesthetic or utilitarian purposes. This adds to the necessity for precise placement of the anchoring fasteners. Errors in location of one of the holes for the permanent fasteners can cause misalignment for the whole row of seats. Such errors are costly to repair at best.

Figure 1:
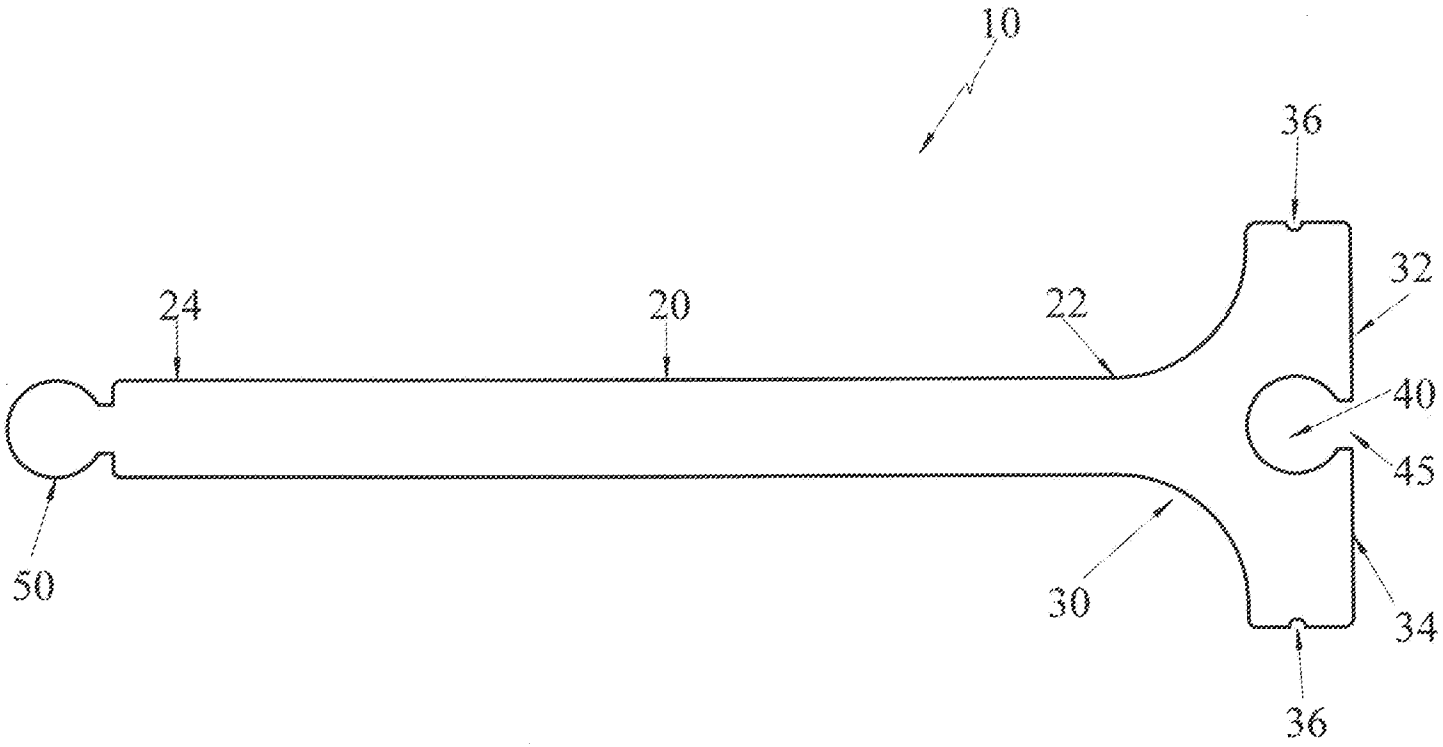
FIG. 1 is a top view of the planar, T-shaped template member of the present invention.
Figure 2:
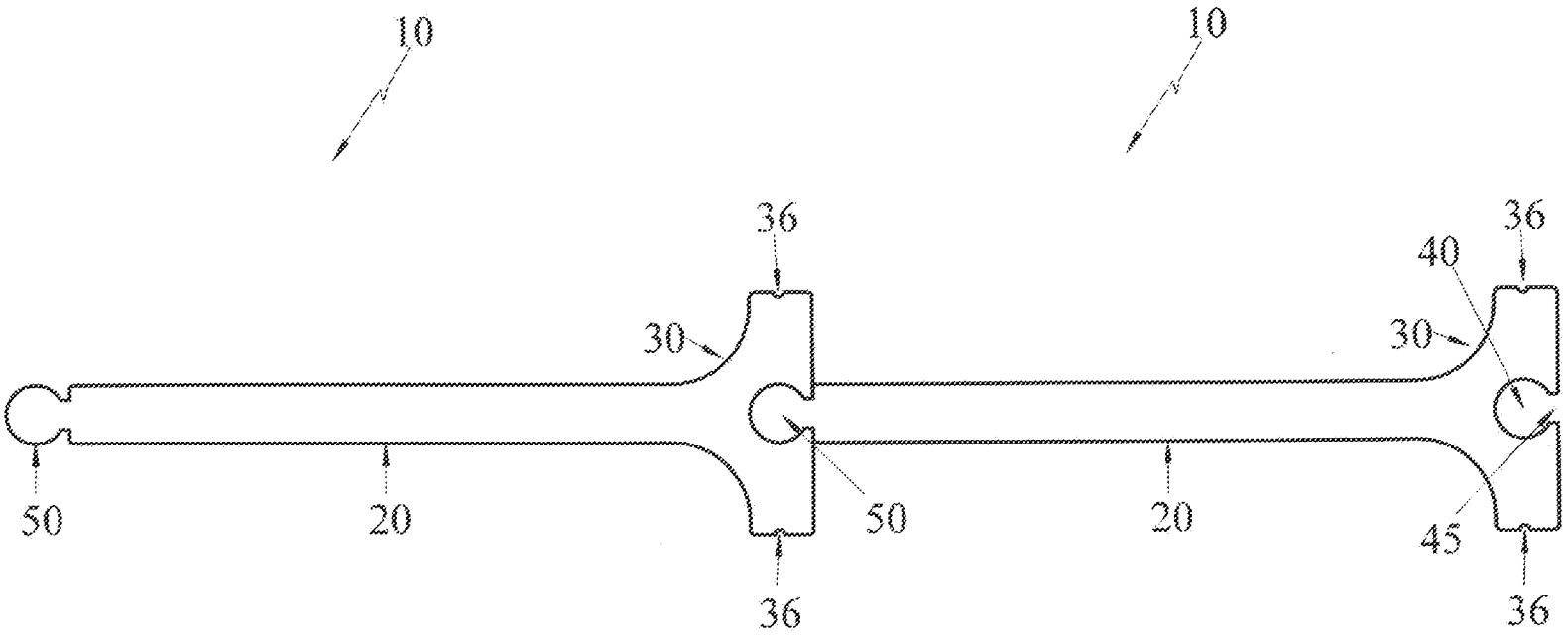
FIG. 2 is a top view of a first planar, T-shaped template member of the present invention connected to a second planar, T-shaped template member of the present invention.

Referring now to FIG. 1, the device comprises a planar, T-shaped template member 10 having a linear leg section 20 with a first end 22 and a second end 24. The first end 22 thereof intersects a linear cross bar section 30 at a center thereof. The cross bar section 30 has opposed ends 32, 34 each end having a feature 36 at a selected location therein, the feature 36 providing location for fasteners on the support surface. The feature 36 may be an arc indentation, as shown in the Figures, or an aperture. The cross bar section 30 also has a circular aperture 40 there through positioned opposite and aligned with the connected leg section 20. The circular aperture 40 is connected to an access channel 45, which provides an opening at an edge of the cross bar section 30 opposite the linear leg section 20. The linear leg section 20 has a protrusion 50 at a second end 24 thereof opposite the cross bar section 30. The protrusion 50 is sized to pivotally fit into the circular aperture 40 and access channel 45 of an identical T-shaped planar template member 10, as shown in FIG. 2, thereby allowing some degree of pivotal movement between connected planar T-shaped template members 10. The protrusion 50 is preferably also circular in shape and fits into circular aperture 40 and access channel 45. Alternatively, the protrusion 50 is a polygon, such as a square or hexagon, either of which fits into the circular aperture 40.

Figure 3:
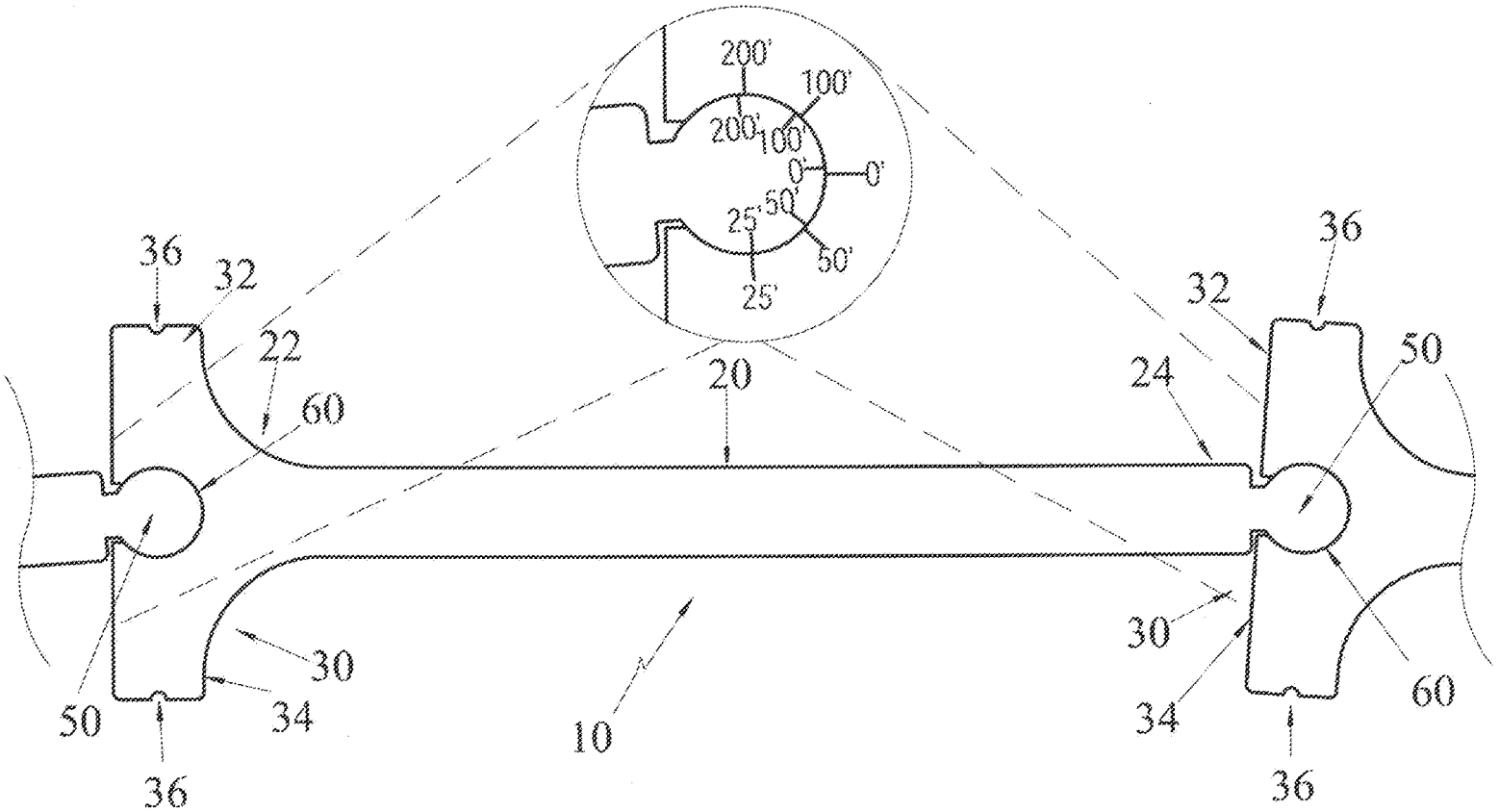
FIG. 3 is a top view of three planar, T-shaped template members of the present invention connected together showing the radially extending surface lines at the pivotal connections.
Figure 4:
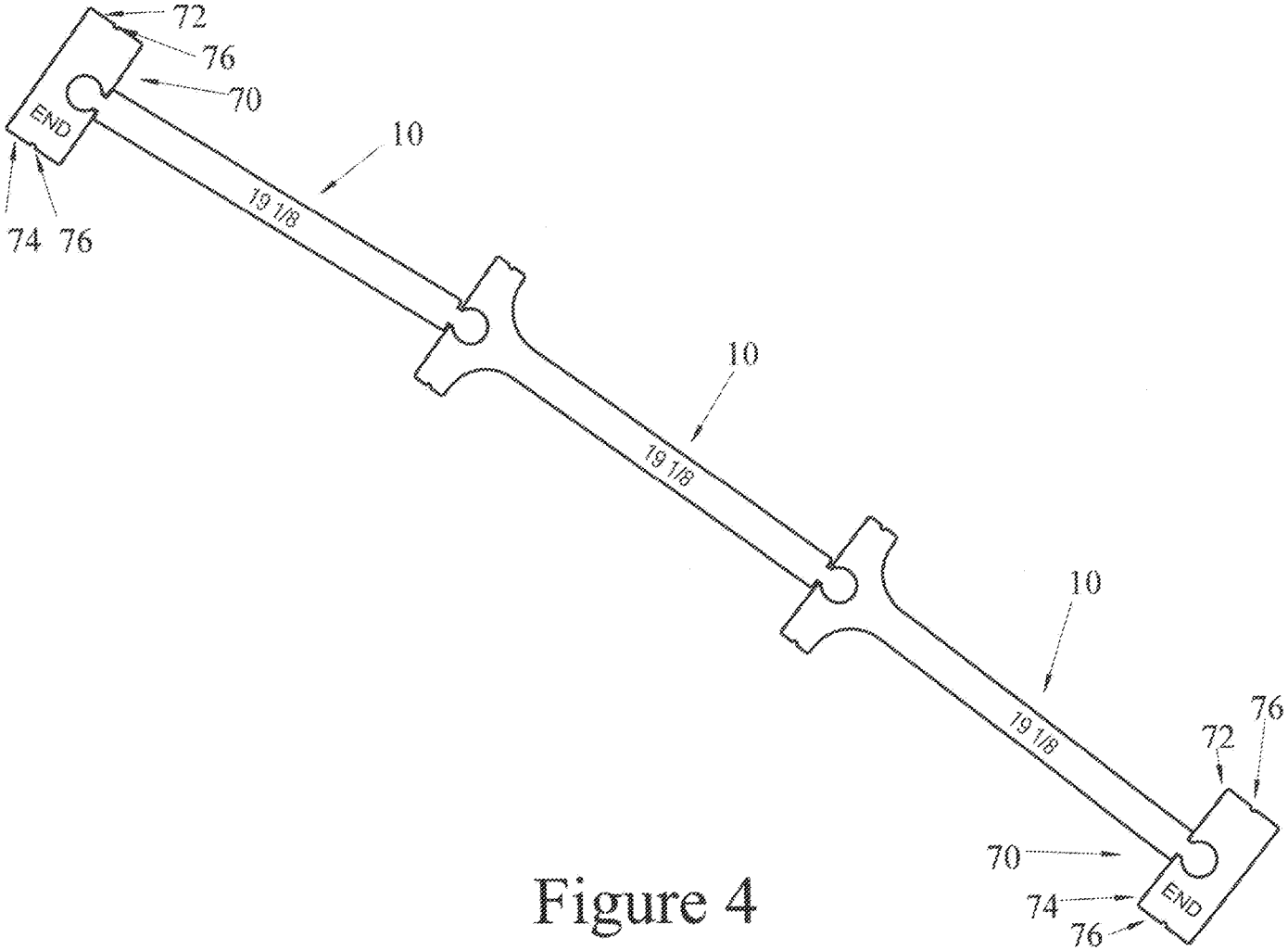
FIG. 4 is a top view of three planar, T-shaped template members of the present invention connected together showing the radially extending surface lines at the pivotal connections and with end pieces positioned at each end of the connected template members.

Referring now to FIG. 3, which illustrates a further embodiment of the invention, the surface of the cross bar section 30 surrounding the circular aperture 40 contains a plurality of spaced apart surface lines 60, with each line 60 extending radially outward from the circular aperture 40. In addition, the surface of the protrusion 50 of the second end 24 of the linear leg section 20, sized to pivotally fit into the circular aperture 40, contains a like plurality of spaced apart surface lines 60 each line 60 extending radially inward from the edge thereof. The spacings between the radially extending lines 60 of the protrusion 50 and those of the cross bar section 30 are not identical. Thus, alignment of a selected pair of surface lines 60, one from each surface, results in a corresponding angle between adjacent, connected planar template members 10. As shown in FIG. 3, the lines denoted as "25" of cross bar section 30 are aligned with the lines denoted as "25" of each protrusion 50. Thus, the angles between adjacent connected template members 10 in a string are identical. This constant angle between adjacent template members 10 is clearly shown in FIG. 4. Thus, identical angles between adjacent, connected planar template members 10 can be maintained across a long string of such template members 10, which produces a smooth curve from the first to the last template member 10. Alternatively, alignment of the lines denoted as "0" of cross bar section 30 with the lines denoted as "0" of each protrusion 50 produces a straight line from the first to the last template members 10.

Referring again to FIG. 4, a cross bar end piece 70 can be used to anchor each end of a string of connected planar template members 10, as illustrated in FIG. 4. The linear cross bar end piece 70 has a first end 72 and a second end 74 with an arc indentation feature 76 at each end thereof. The end piece 70 has a circular aperture 40 connected to an access channel 45, which provides an opening at an edge of the end piece 70. Protrusion 50 of the template member 10 fits into the circular aperture 40, as shown at the right end of the string of connected planar template members 10. The end piece 70 includes radial lines 60, as described previously, used to rotatably position the end piece 70 relative to the string of connected template members 10. The T-shaped template member 10 at the left end of the string of connected template members 10 in FIG. 4 includes the above described rotatable connection between the leg section 20 and the linear end piece 70 to properly orient the arc indentation features 36 at each end of the linear end piece 70.

Figure 5:
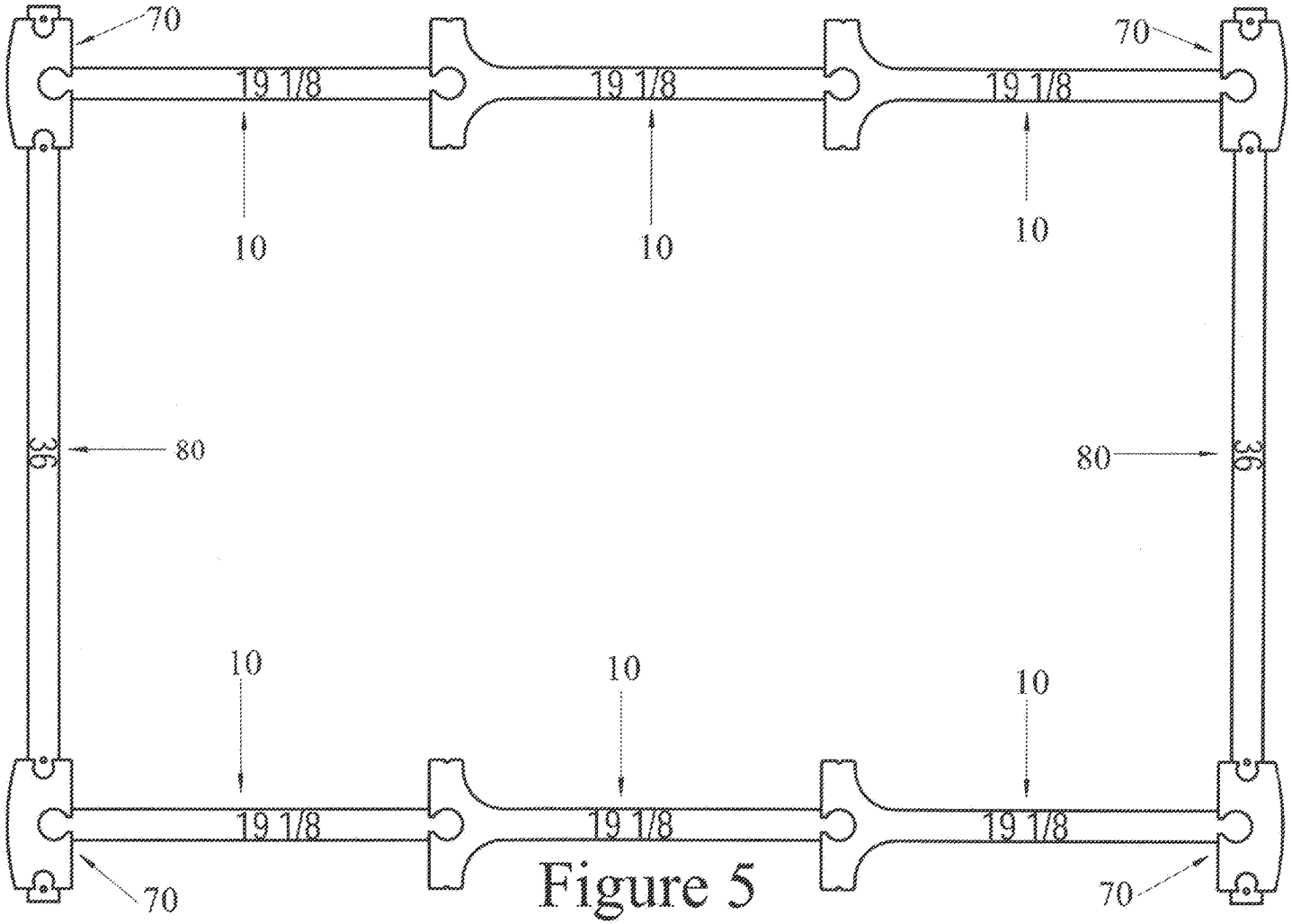
FIG. 5 is a top view of a large number of planar, T-shaped template members of the present invention connected together in two adjacent rows with spacers maintaining a selected distance between the ends of the two adjacent rows.

To properly position parallel strings of connected template members 10, long spacer connecting pieces 80 between adjacent strings of connected planar template members 10 assist in maintaining constant spacing between the adjacent strings of connected template members 10, as illustrated in FIG. 5.

The planar, template member 10 and is preferably fabricated from a rigid material, such as fiber board or polymeric resin plastic, as are the spacer connecting pieces. Thus, the planar, template members 10 and the cross bar end pieces 70 can be used multiple times, reducing the per use cost for each of the templates 10 and 70.

While the invention has been particularly shown and described with reference to preferred embodiments thereof, it will be understood by those skilled in the art that various changes in form and details may be made therein without departing from the spirit and scope of the invention.

What is claimed is:

1. A planar, T-shaped template member having a linear leg section with a first end thereof rigidly intersecting a cross bar section at a center thereof;

the cross bar section having opposed ends, each end having a feature at a selected location therein;

the cross bar section having a circular aperture there through positioned opposite and aligned with the leg section, the circular aperture connected to an access channel extending to an edge of the cross bar section opposite the linear leg section;

the linear leg section having a circular protrusion at a second end thereof opposite the cross bar section, the circular protrusion sized to pivotally fit into the circular aperture and access channel of an identical T-shaped planar template member, thereby allowing pivotal movement between connected planar T-shaped template members.

2. The planar, T-shaped template member of claim 1, wherein the feature at each end of the cross bar section is an arc indentation.

3. The planar, T-shaped template member of claim 1, wherein the feature at each end of the cross bar section is an aperture.

4. The planar, T-shaped template member of claim 1, further comprising a plurality of spaced apart surface lines on the cross bar section, each surface line extending radially outward from the circular aperture therein; and a like plurality of spaced apart surface lines on the circular protrusion of the second end of the linear leg section, each surface line extending radially inward from the edge of the protrusion.

5. The planar, T-shaped template member of claim 1, wherein the planar, T-shaped template member is fabricated from fiber board.

6. The planar, T-shaped template member of claim 1, wherein the planar, T-shaped template member is fabricated from a polymeric resin.

7. A planar, T-shaped end cap template member having a linear leg section with a first end thereof rotatably intersecting a cross bar section at a center thereof;

the cross bar section having opposed ends, each end having an arc channel feature there through;

the cross bar section having a circular aperture there through positioned adjacent the leg section, the circular aperture connected to an access channel extending to an edge of the cross bar section adjacent the linear leg section;

the linear leg section having a circular protrusion at first and second ends thereof, one circular protrusion sized to pivotally fit into the circular aperture and access channel of the cross bar section, thereby allowing pivotal movement between the linear leg section and the cross bar section;

a plurality of spaced apart surface lines on the cross bar section, each surface line extending radially outward from the circular aperture therein; and a like plurality of spaced apart surface lines on the circular protrusion of the first end of the linear leg section, each surface line extending radially inward from the edge of the protrusion.

8. The planar, T-shaped template member of claim 7, wherein the spacing between the radially extending lines of the cross bar section and the protrusion of the second end of the linear leg section are not identical.

9. The planar, T-shaped template member of claim 7, wherein the planar, T-shaped template member is fabricated from fiber board.

10. The planar, T-shaped template member of claim 7, wherein the planar, T-shaped template member is fabricated from a polymeric resin.

11. A linear cross bar end cap template member comprising;

a linear cross bar member having opposed ends, each end having an arc channel feature there through;

the cross bar section having a circular aperture there through connected to an access channel extending to an edge of the cross bar section at a midpoint of the cross bar end cap template member;

the circular aperture and access channel sized to accept a circular protrusion at one end of a leg section of a template member, thereby providing pivotal movement there between.

12. The linear cross bar end cap template member of claim 11, wherein a second end of the linear leg section is rigidly attached to a cross bar section.

13. The linear cross bar end cap template member of claim 11, wherein a second end of the linear leg section includes a protrusion sized to fit into an aperture and access channel of a template member.

14. The linear cross bar end cap template member of claim 11, further including a plurality of spaced apart surface lines on the cross bar section, each surface line extending radially outward from the circular aperture therein, and the circular protrusion accepted by the circular aperture and access channel of the linear cross bar end cap template member includes a like plurality of spaced apart surface lines, each surface line extending radially inward from the edge of the protrusion.

* * * * *